US008215368B2

(12) United States Patent
Ellis

(10) Patent No.: US 8,215,368 B2
(45) Date of Patent: Jul. 10, 2012

(54) RELEASABLE TASSEL

(75) Inventor: Nicholas Mark Ellis, Leeds (GB)

(73) Assignee: Hunter Douglas Industries BV, El Rotterdam (NL)

( * ) Notice: Subject to any disclaimer, the term of this patent is extended or adjusted under 35 U.S.C. 154(b) by 157 days.

(21) Appl. No.: 12/441,084

(22) PCT Filed: Sep. 14, 2007

(86) PCT No.: PCT/GB2007/003494

§ 371 (c)(1),
(2), (4) Date: Mar. 12, 2009

(87) PCT Pub. No.: WO2008/032090

PCT Pub. Date: Mar. 20, 2008

(65) Prior Publication Data

US 2010/0051213 A1 Mar. 4, 2010

(30) Foreign Application Priority Data

Sep. 15, 2006 (GB) ..... 0618162.2

(51) Int. Cl.
*E06B 9/32* (2006.01)

(52) U.S. Cl. ..... 160/178.1 R; 160/173 R

(58) Field of Classification Search ..... 160/178.1 R, 160/173 R, 168.1 R, 320
See application file for complete search history.

(56) References Cited

U.S. PATENT DOCUMENTS

| | | | | | |
|---|---|---|---|---|---|
| 422,292 | A | * | 2/1890 | Chase | 160/277 |
| 1,185,406 | A | * | 5/1916 | Jaekel | 160/122 |
| 2,321,491 | A | * | 6/1943 | Keys et al. | 160/84.01 |
| 3,485,285 | A | | 12/1969 | Anderle | |
| 3,727,665 | A | * | 4/1973 | Debs | 160/178.2 |
| 4,335,776 | A | * | 6/1982 | Debs | 160/320 |
| 4,366,852 | A | * | 1/1983 | Holzer | 160/320 |
| 4,411,044 | A | * | 10/1983 | Volfson | 16/219 |
| 4,909,298 | A | | 3/1990 | Langhart et al. | |
| 5,242,006 | A | * | 9/1993 | Ortega | 160/344 |
| 5,485,875 | A | | 1/1996 | Genova | |
| 5,518,057 | A | * | 5/1996 | Huang | 160/178.1 R |
| 5,542,461 | A | * | 8/1996 | Huang | 160/178.1 R |
| 5,542,462 | A | * | 8/1996 | Elsenheimer et al. | 160/178.1 R |
| 5,630,458 | A | * | 5/1997 | Holden | 160/178.1 R |
| 6,637,493 | B1 | * | 10/2003 | Lampers | 160/178.1 R |
| 7,562,689 | B1 | * | 7/2009 | Militello et al. | 160/84.04 |
| 2004/0123958 | A1 | | 7/2004 | Krug | |
| 2005/0087312 | A1 | | 4/2005 | Nien | |

* cited by examiner

*Primary Examiner* — David Purol
(74) *Attorney, Agent, or Firm* — Dorsey & Whitney LLP

(57) ABSTRACT

A covering for an architectural opening and a method of arranging at least one movement cord includes a cover extending between an uppermost member and a lowermost member, an active end of the at least one movement cord being attached to the lowermost member and extending from the lowermost member to the uppermost member and the at least one movement cord extending, as the loose length, from the uppermost member to a distal end.

19 Claims, 3 Drawing Sheets

RELEASABLE TASSEL

CROSS-REFERENCE TO RELATED APPLICATIONS

This application is a 371 application of PCT/GB07/03494 filed Sep. 14, 2007, which application claims priority to GB 0618162.2 filed Sep. 15, 2006. Both of these applications are incorporated by reference into the present application in their entirety.

BACKGROUND OF THE INVENTION

1. Field of the Invention

The following invention relates to improvements to blinds, in particular, but not limited to, Venetian blinds.

2. Description of the Relevant Art

Venetian blinds typically comprise a plurality of horizontal slats connected together by threads at either end. A bar or lowermost member is provided at the bottom of the slats. This can be raised and lowered by pulling on movement cords connecting the bar to a top portion attached to a wall or frame. The cords shorten or lengthen the vertical length of the blind by moving the bar towards or away from the top portion.

The cords for movement of the blind are usually threaded along the top portion of the blind and collated at a side thereof to hang down at or near one side of the blind for easy access by the user.

When the blind is fully extended in the lowered configuration, the cords typically extend to substantially the same vertical length as the blind. However, when the blind is raised by pulling on the movement cords, the same cords extend by the same length again to take up the additional cord length. This can lead to the cords being inconveniently tangled and/or the cords extending to and gathering on a surface therebelow. This can be aesthetically displeasing.

SUMMARY OF THE INVENTION

An aim of the present invention is to provide a blind in which the cord is less likely to become tangled, thereby overcoming the above disadvantages.

According to the present invention, there is provided a method of arranging a loose length of at least one movement cord of an architectural opening covering, the architectural opening covering having a cover extending between an uppermost member and a lowermost member, an active end of the at least one movement cord being attached to the lowermost member and extending from the lowermost member to the uppermost member and the at least one movement cord extending, as the loose length, from the uppermost member to a distal end, the method including: securing the distal end to a releasable tassel; and releasably attaching the releasable tassel to the lowermost member.

According to the present invention, there is also provided a releasable tassel for an architectural opening covering having a cover extending between an uppermost member and a lowermost member and at least one user-operable movement cord having an active end attached to the lowermost member, the at least one movement cord extending from the lowermost member, via the uppermost member, to a distal end, wherein: the tassel is configured to receive and be secured to the distal end of the at least one movement cord; and the tassel is configured to releasably attach to the lowermost member.

The releasable tassel may be received and secured to the distal end of at least one movement cord in an architectural opening covering including: an uppermost member; a lowermost member; a cover extending between the uppermost member and the lowermost member; at least one user-operable movement cord having an active end and a distal end, the active end being attached to the lowermost member and the movement cord extending from the lowermost member, via the uppermost member, to the distal end such that movement of the distal end away from the uppermost member results in the movement cord drawing the lowermost member towards the uppermost member.

In this way, as the movement cord is pulled down away from the uppermost member, thereby providing a longer loose length of cord extending from the uppermost member, the tassel moves upwards with the lowermost member, thereby taking up the extra loose length of movement cord. As a result, the length of drop of the movement cord below the uppermost member remains substantially constant.

By providing the tassel as a releasable tassel for releasable attachment to the lowermost member, improved safety is achieved, for instance to safeguard if a child got caught in the loop formed by the movement cord.

Preferably, the tassel includes a cord portion configured to receive and secure the distal end of the at least one movement cord.

In some embodiments, the tassel may receive only one movement cord and, in other embodiments, the tassel may receive a plurality of movement cords. In this respect, it is possible for a plurality of movement cords to extend from the lowermost member to the uppermost member and then be joined to only one cord, such that, although the tassel is only secured to one cord, that one cord in effect operates a plurality of cords attached to the lowermost member.

Preferably, the tassel includes an attachment portion configured to releasably attach to the lowermost member.

The attachment portion may be a separate portion included within the overall tassel or may be an integral part of the tassel.

The attachment portion may take a number of different forms suitable for releasably attaching the tassel to the lowermost member.

In a preferred embodiment, the attachment portion is magnetic for releasably attaching the tassel to a ferromagnetic or magnetic portion of the lowermost member. It is also possible for the lowermost member to include a magnet for releasably attaching a magnetic or ferromagnetic attachment portion in the tassel.

Other two-part releasable attachments can also be used, such as hook-and-loop fasteners, for instance Velcro (registered trade mark).

The architectural opening covering can be of any known type having a movement cord for operating a cover. The preferred embodiment is described as a Venetian blind, but the present invention is applicable to other coverings, such as pleated blinds, cellular shades, etc.

The present invention may thus provide a blind comprising; a plurality of substantially horizontal members; at least one cord which can be manipulated to allow said blind to be moveable between a raised configuration and a lowered configuration by varying the length of the at least one cord which extends from the blind; wherein the distal end of the at least one cord extending from the blind is selectively attachable to the lowermost member.

In one embodiment a plurality of movement cords are provided with said cords gathered at their free ends with a single operating member. In another embodiment, especially when the blind is longer in length, a plurality of movement cords are provided which are gathered at their free ends with more than one operating member. The operating members are typically grasped by the user to allow the movement of the blind to be achieved, either by exerting a pulling action to shorten the length of the blind, or by moving the same to operate a release mechanism in the top portion which allows the length of the blind to be increased.

Thus as the blind is raised or lowered, the distal ends of the cords can be attached to the lowermost part of the blind such that the vertical drop of the cords extending therefrom remains substantially constant.

In one embodiment the distal ends of the cords are attached to the blind by attachment of the operating member(s) to which the same are attached.

Typically the distal ends of the cords or operating member and/or the lowermost member are provided with attachment means comprising any or any combination of hooks, loops, catches, studs, magnets, hook and loop fastenings, and/or the like.

In one embodiment the lowermost member of the blind is made of steel, and the distal ends of the cords are provided with a magnet for selectively attaching thereto. The person skilled in the art will appreciate that the lowermost member could be made of other materials which are attractive to magnets may be used.

In one embodiment there is provided a weight threaded onto the cords to help prevent the cords from tangling.

Typically the weight is slidably mounted on the cords. Thus the weight of the same helps maintain the configuration of the cords with a substantially constant drop.

In one embodiment the horizontal members depend from a top portion which acts as a housing.

Typically the cords are connected to the lowermost member of the blind and pass though openings in the horizontal members before passing through the housing.

Typically the cords pass through the housing from the members and the distal ends of the cords extend down from the housing to allow a user to move the blind between the raised and lowered configurations.

Thus, as the blind is raised the horizontal members are collated, but the drop of the cords extending from the blind does not substantially increase due to the attachment of the distal ends or the operating member to the lowermost portion of the blind. This prevents tangling and the displeasing aesthetics of the cords which would otherwise gather on the surface therebelow.

BRIEF DESCRIPTION OF THE DRAWINGS

Specific embodiments of the invention are now described wherein.

DESCRIPTION OF THE PREFERRED EMBODIMENTS

Figure 1B:
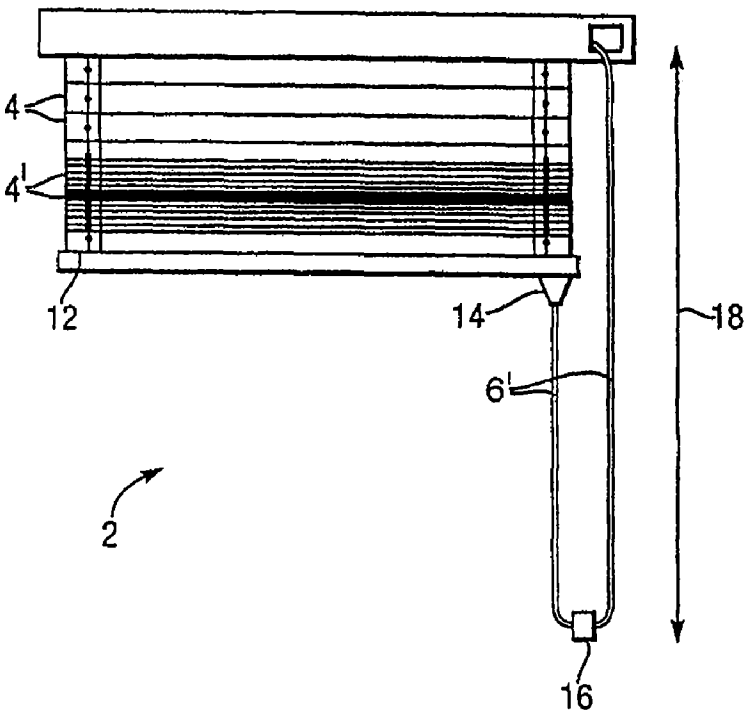
FIGS. 1*a* and 1*b* illustrate a blind according to the present invention (a) in a lowered configuration, and (b) in a raised configuration.
Figure 1A:
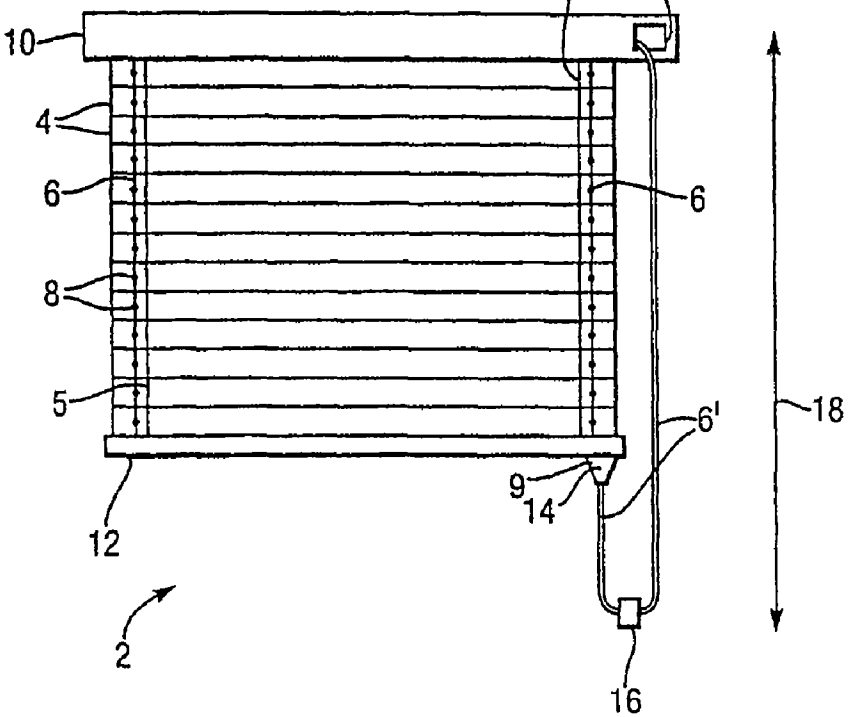

With reference to FIGS. 1*a-b*, there is illustrated a Venetian blind comprising a plurality of horizontal members in the form of slats 4, connected together by threads 5. Also provided are a series of movement cords 6 which pass through openings 8 towards each end of the slats 4 such that the planar faces of the slats are substantially vertical when the blind is in the lowered configuration.

The cords 6 pass through a housing 10 from which the slats depend, and extend down from the housing 10 via an opening 13 as shown to run down along one side of the blind. The user can pull on this portion of the cords 6' typically via an operating member or tassel 9 which is located at the distal ends of the cords, to move the blind 2 to the raised configuration shown in FIG. 1*b*.

The housing 10 includes a catch/release system (not shown) which maintains the length of the cords 6' extending from the blind and hence if the user lets go, or releases the cords 6' to lower the blind, depending on the angle at which the cords are pulled relative to the housing 10.

With reference to FIG. 1*b*, in the raised configuration, the lowermost slats 4' rotate such that the planar faces thereof move from a substantially vertical condition to a substantially horizontal condition, to allow the same to collate as the blind 2 is raised.

As illustrated, the operating member or tassel 9 can be selectively attached to the bottom of the lowermost member 12.

Figure 2A:
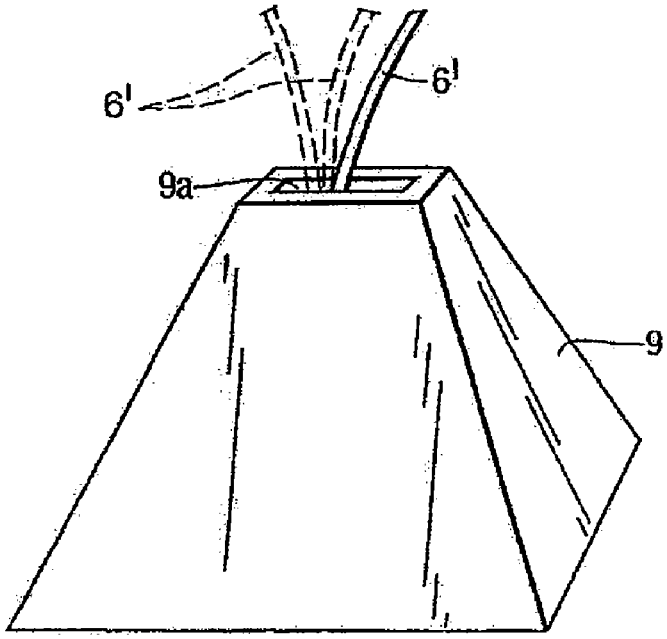
FIGS. 2*a* and 2*b* illustrate the releasable tassel of FIGS. 1*a* and 1*b*.
Figure 2B:
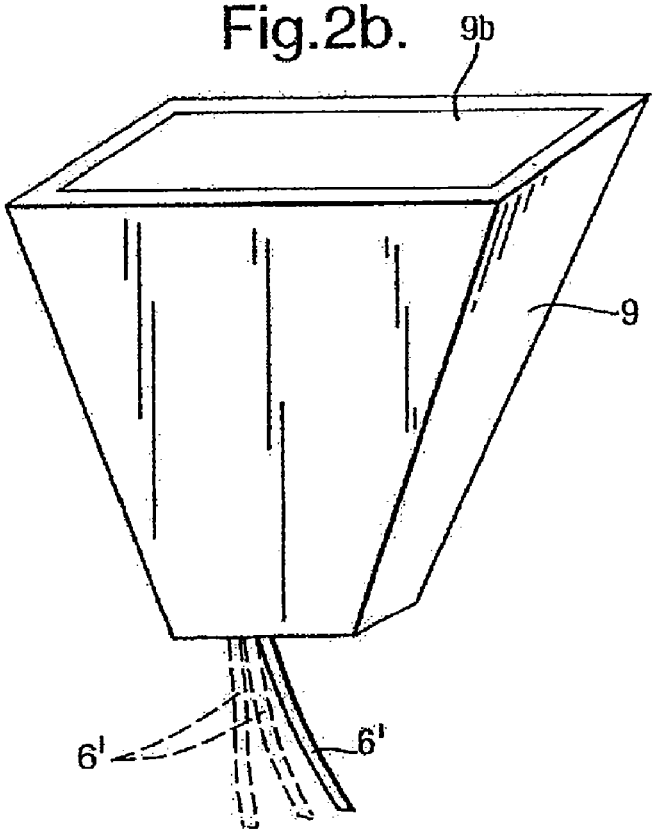

FIGS. 2*a* and 2*b* illustrate an example of a tassel 9 receiving and secured to a cord 6'.

A first portion 9*a* of the tassel 9 is arranged to receive the distal end of one or more cords 6' (some shown in dashed lines) and to be secured to those cords 6'. As illustrated, the first portion is configured as a cord portion including an aperture 9*a* through which the cord 6' passes.

Figure 3:
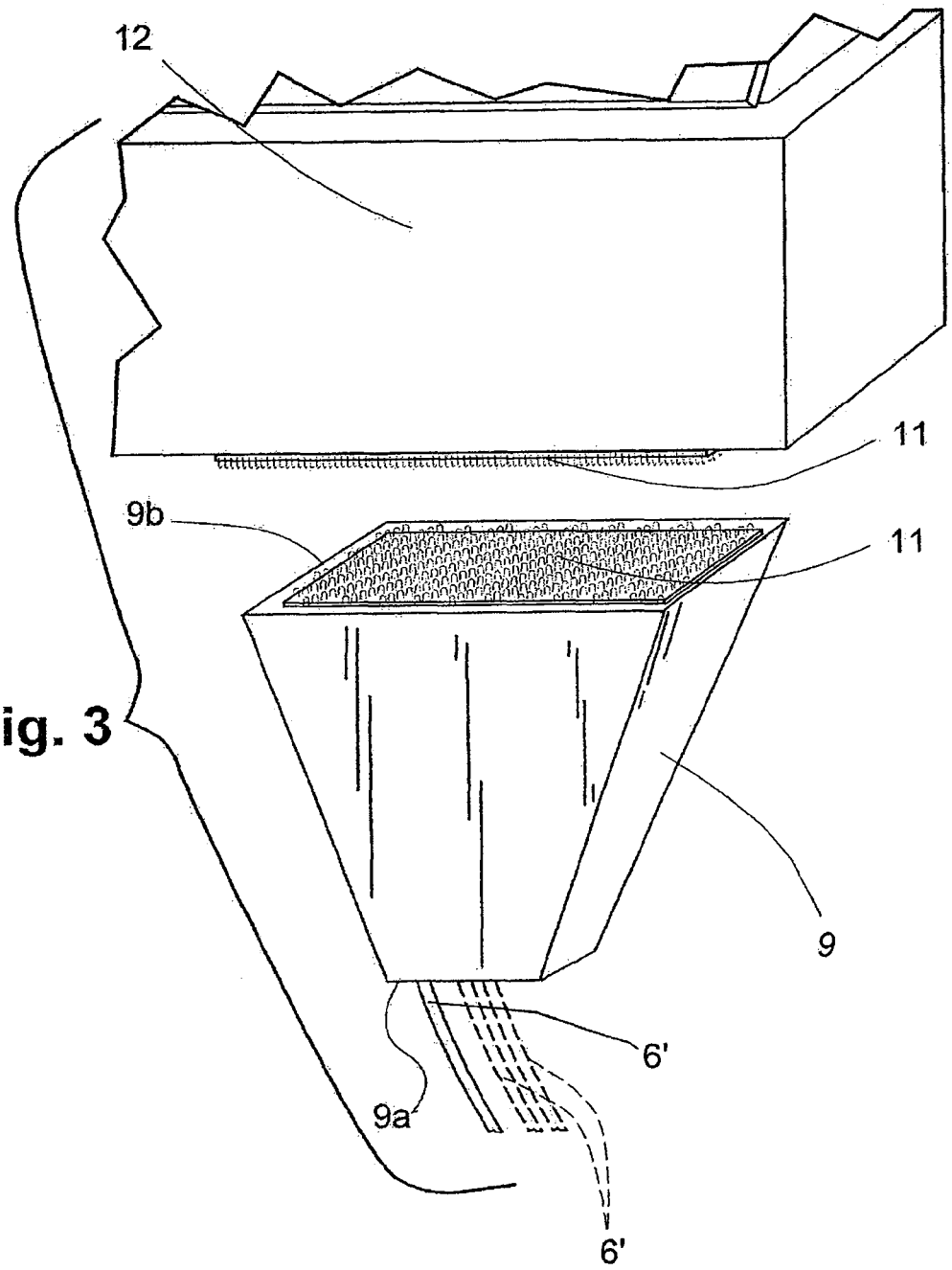
FIG. 3 illustrates a releasable tassel using a hook-and-loop type fastener.

On an opposite side of the tassel 9, there is provided an attachment portion 9*b*. The attachment portion forms one half of a two-part attachment for releasably attaching the tassel 9 to the lowermost member 12. Any suitable form of releasable attachment may be used, such as hook-and-loop fasteners 11, for instance Velcro (trade mark) (see FIG. 3). In one embodiment, the tassel can be formed as a magnetic tassel (see FIG. 2*b*) or end construction. The attachment portion 9*b* may be formed with a magnet which is intended to releasably attach to at least a ferromagnetic portion or a magnetic portion of the lowermost member 12. Alternatively, if the lowermost member 12 is provided with a magnetic portion, the attachment portion 9*b* of the tassel 9 could merely be of any suitable ferromagnetic material.

It will be appreciated that the attachment portion 9*b* could be provided as a separate part which is installed or fitted in the tassel 9 or, alternatively, could be an integral part of the tassel 9 itself.

Thus, in one embodiment of the invention the distal ends of the cords 6' or operating member 9 are provided with a magnet 14, and the lowermost member 12 is made of steel or other ferrous material. This allows the operating member 9 and hence the distal ends of the cords 6' to be selectively attached to the bottom of the blind 2.

A weight 16 can be provided, having a main body and defining an aperture directly through which the cords 6' pass, such that as the blind is moved to a raised configuration, the weight moves along the cords under the action of gravity, such that the weight is maintained at the lowermost position of the cords 6'.

Thus, as the blind is raised and lowered, the length of drop 18 of the cords 6' does not substantially change, and the weight helps prevent the cords 6' from tangling.

As the cords 6' extending from the housing 10 are maintained at a substantially constant drop, and do not gather on the surface therebelow, the appearance of the blind 2 is more aesthetically pleasing, and in addition, the blind 2 of the present invention is provided with cords 6' which are less likely to get knotted or tangled.

It will be appreciated by those skilled in the art that other means can be used to attach the distal ends of the cords to the lowermost portion of the blind, such as hooks, loops, catches, studs, magnets, hook and loop fastenings, and/or the like. This attachment can be permanent or temporary. It is preferred however, that the attachment is selectively detachable such that if for example a child got caught in the loop formed, the distal ends of the cords would be easily releasable to break the loop and release the child.

It will also be appreciated by persons skilled in the art that the present invention also includes further additional modifications made to the device which does not effect the overall functioning of the device.

The invention claimed is:

1. A covering for an architectural opening comprising:

a cover extending between an uppermost member and a lowermost member;

at least one manually-operable movement cord having a distal end selectively attached to the lowermost member, the at least one movement cord extending from the uppermost member to the lowermost member a releasable tassel at said distal end comprising:

a first portion that receives and secures to the distal end of the at least one movement cord; and an attachment portion that selectively and releasably attaches to the lowermost member; and a weight having a main body defining an aperture directly through which the at least one movement cord slidably passes, the weight being located between the uppermost member and the tassel at a lowermost point of the movement cord, the weight being freely moveable along the at least one movement cord while remaining at the lowermost point of the movement cord.

2. A covering according to claim 1, wherein the attachment portion includes at least one part which is magnetic for releasably attaching the tassel to the lowermost member.

3. A covering according to claim 1, wherein the attachment portion includes one of two parts of a releasable attachment for releasably attaching to the other of the two parts as provided on the lowermost member.

4. A covering according to claim 3, wherein the attachment portion comprises a hook-and-loop fastener.

5. A covering according to claim 1, wherein the attachment portion includes at least one part which is ferromagnetic for releasably attaching the tassel to a magnetic portion provided on the lowermost member.

6. A covering according to claim 1, wherein the tassel is secured to a plurality of distal ends of a respective plurality of movement cords for an architectural opening covering.

7. An architectural opening covering including:

an uppermost member;

a lowermost member;

a cover extending between the uppermost member and the lowermost member;

at least one user-operable movement cord having an active end and a distal end, the distal end being selectively attached to the lowermost member and the movement cord extending from the uppermost member to the lowermost member such that movement of the distal end away from the uppermost member results in the movement cord drawing the lowermost member towards the uppermost member;

a releasable tassel including a first portion that receives and is secured to the distal end of the at least one movement cord; and an attachment portion that selectively attaches and releases from the lowermost member; and a weight having a main body and defining an aperture directly through which the at least one user-operable movement cord slidably passes, the weight being located between the uppermost member and the tassel, and at a lowermost point of the at least one user-operable movement cord, the weight being freely moveable along the at least one user-operable movement cord while remaining at the lower most point of the at least one user-operable movement cord.

8. An architectural opening covering according to claim 7, wherein the attachment portion is a magnet and the lowermost member includes at least a ferromagnetic portion for releasable attachment to the attachment portion of the tassel.

9. An architectural opening covering according to claim 7, wherein the attachment portion is a magnet and the lowermost member includes at least a magnetic portion for releasable attachment to the attachment portion of the tassel.

10. An architectural opening covering according to claim 7, wherein the tassel includes one of two parts of a releasable attachment and the lowermost member includes the other of the two parts of the releasable attachment.

11. An architectural opening covering according to claim 10, wherein the attachment portion comprises a hook-and-loop fastener.

12. An architectural opening covering according to claim 7, wherein the at least one movement cord includes a plurality of user-operable movement cords having respective active ends attached to the lowermost member.

13. An architectural opening covering according to claim 12, wherein the plurality of user-operable movement cords have respective distal ends received and secured by the tassel.

14. An architectural opening covering according to claim 7, wherein the architectural opening covering is a Venetian blind and the cover includes a plurality of members, each member being arranged horizontally and the plurality of members being arranged in a vertical array between the uppermost member and the lowermost member.

15. A method of arranging a loose length of at least one manually operable movement cord of an architectural opening covering the architectural opening covering having a cover extending between an uppermost member and a lowermost member, a distal end of the at least one movement cord being attached to the lowermost member and extending from the uppermost member to the lowermost member, the method comprising:

securing the distal end to a releasable tassel which includes a first portion that receives the distal end of the at least one movement cord and an attachment portion that selectively attaches to the lowermost member;

releasably attaching the releasable tassel to the lowermost member; and slidably attaching a weight having a main body defining an aperture to the movement cord such that the movement cord is directly received through the aperture, the weight being positioned between the uppermost member and the releasable tassel such that the weight remains at a lowermost point of the movement cord.

16. A covering for an architectural opening comprising:

a cover extending between an upper member and a lower member;

at least one control cord accessible by a user for moving the cover to at least one position and extending between the upper member and the lower member;

a tassel comprising a first portion operably connected to a distal end of the at least one control cord and an attachment portion configured to releasably attach to the lower member; and a weight having a main body and defining an aperture directly through which the at least one control cord slidably passes, the weight located on the at least one control cord between the upper member and the tassel, and at a lowermost point of the at least one control cord; wherein the weight is freely moveable along the at least one control cord, while remaining at the lowermost point of the at least one control cord.

17. The covering of claim 16, wherein as the cover moves from an extended position to a retracted position, a length of drop of the at least one control cord remains substantially the same.

18. The covering of claim 16, wherein the tassel has a frustum shape and the attachment portion is a bottom surface of the tassel and selectively and releasably attaches to the lower member and the first portion is a top surface of the tassel that defines an aperture for receiving the at least one control cord.

19. The covering of claim 16, wherein the weight prevents the at least one control cord from becoming entangled without providing a counterbalancing force.

* * * * *